United States Patent [19]

Shiinoki et al.

[11] Patent Number: 4,767,284

[45] Date of Patent: Aug. 30, 1988

[54] SCREW VACUUM PUMP UNIT

[75] Inventors: Kazuaki Shiinoki; Koutarou Naya, both of Ebina; Shinji Mitsuhashi, Yokohama; Tadashi Hayakawa, Ebina; Riichi Uchida, Ibaraki, all of Japan

[73] Assignee: Hitachi, Ltd., Tokyo, Japan

[21] Appl. No.: 21,645

[22] Filed: Mar. 4, 1987

[30] Foreign Application Priority Data

Mar. 20, 1986 [JP] Japan ..... 61-60572

[51] Int. Cl.[4] ..... F04C 18/16

[52] U.S. Cl. ..... 417/312; 417/410; 418/201

[58] Field of Search ..... 418/15, 191, 201–203; 417/312, 410

[56] References Cited

U.S. PATENT DOCUMENTS

| | | | |
|---|---|---|---|
| 1,844,105 | 2/1932 | Schnell | 417/312 |
| 2,260,237 | 10/1941 | Stahl | 417/312 |
| 2,474,653 | 6/1949 | Boestad | 418/201 |
| 2,705,922 | 4/1955 | Rathman | 418/201 |
| 2,849,988 | 9/1958 | Nilsson | 418/201 |
| 2,935,247 | 5/1960 | Trulsson | 418/203 |
| 3,388,854 | 6/1968 | Olofsson | 418/203 |

FOREIGN PATENT DOCUMENTS

| | | | |
|---|---|---|---|
| 0005327 | 4/1979 | European Pat. Off. . | |
| 0166851 | 1/1986 | European Pat. Off. . | |
| 2413787 | 8/1975 | Fed. Rep. of Germany . | |
| 3311817 | 10/1984 | Fed. Rep. of Germany . | |
| 54-40316 | 3/1979 | Japan . | |
| 54-309 | 4/1979 | Japan | 418/201 |
| 2114228 | 1/1983 | United Kingdom . | |
| 420803 | 8/1979 | U.S.S.R. | 418/15 |

*Primary Examiner*—Carlton R. Croyle
*Assistant Examiner*—Jane E. Obee
*Attorney, Agent, or Firm*—Antonelli, Terry & Wands

[57] ABSTRACT

The present invention provides a screw vacuum pump unit in which both a screw block and a driving motor are mounted on one side surface of a casing of a speed change gear, both axes of a male rotor and a female rotor in the screw block are arranged in vertical adjacency within a substantially perpendicular virtual plane, and suction ports and discharge ports are arranged on both sides with the vertical plane intervening therebetween, whereby maintenance can be facilitated.

12 Claims, 4 Drawing Sheets

SCREW VACUUM PUMP UNIT

BACKGROUND OF THE INVENTION

The present invention relates to a screw pump unit.

As disclosed in the official gazette of Japanese patent application Laid-open No. 60-216089 (the specification of U.S. Ser. No. 701,199), a prior-art screw vacuum pump is such that a pair of male and female rotors which rotate meshing with each other are received in the working chamber of a casing which has suction ports and discharge ports, and that the rotors are driven by a driver, whereby a gas is imbibed from a space to have its pressure lowered, into the interstice between both the rollers, and it has its pressure raised and is exhausted into the atmosphere.

In the prior-art unit, the axes of the male rotor and female rotor are arranged within a horizontal plane, and both the rotors are arrayed within the horizontal plane, so that a floor area required for installation enlarges. Moreover, on account of the structure in which the suction ports and discharge ports of the casing are arranged on both the sides of tne horizontal plane (in the upper surface of the casing and the lower surface thereof), either the suction ports or the discharge ports are lie in the lower surface of the casing. Therefore, the job of connecting pipes to the suction ports or the discharge ports lying in the lower surface of the casing must be carried out at the lower surface of the casing, and the job efficiency is very inferior. Further, in a case where reaction products have deposited in the vacuum pump as in use for the evacuation of a semiconductor manufacturing plant, it is not easy to eliminate the products or to routinely inspect the situation of deposition. In performing these operations, there are the problems that pipes need to be detached and that special tools are required.

SUMMARY OF THE INVENTION

An object of the present invention is to provide a screw vacuum pump unit which can facilitate maintenance.

Another object of the present invention is to provide a screw vacuum pump unit which can decrease a floor area for installation and can simultaneously faciliate maintenance.

The present invention for accomplishing the objects is characterized in that both a screw block and a motor are mounted on one side surface of the casing of a speed change gear, that the axes of both male and female rotors in the screw block are arranged in vertical adjacency within a plane substantially perpendicular to a horizontal plane, and that suction ports and discharge ports are arranged on both sides with the perpendicular plane intervening therebetween.

Since, as described above, the male rotor and the female rotor are arrayed in the perpendicular (vertical) direction, the floor area suffices with an extent for receiving a single rotor and can be made smaller than in the prior art. Simultaneously, since the suction ports and the discharge ports are respectively located on the right side and left side of both the rotors and are prevented from lying at the lower surface of the casing, a job for connecting pipes to the suction and discharge ports and jobs for maintenance, such as the clearing and inspection of deposits, can be readily conducted.

PREFERRED EMBODIMENTS OF THE INVENTION

Figure 1:
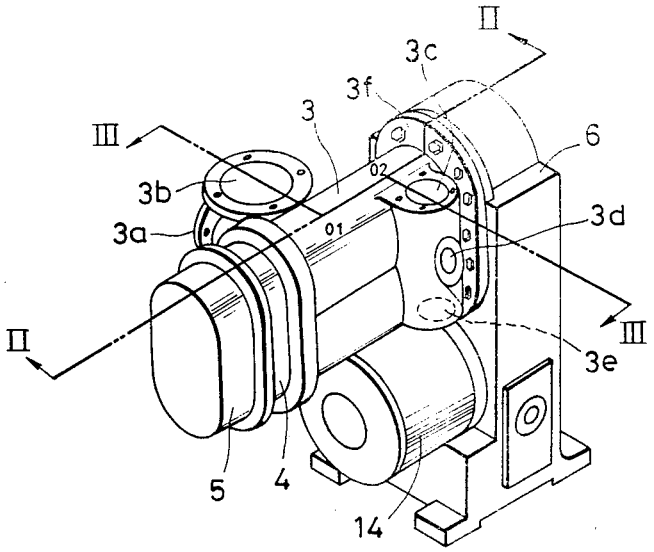
FIG. 1 is an exterior view of a screw vacuum pump showing an embodiment of the present invention.
Figure 2:
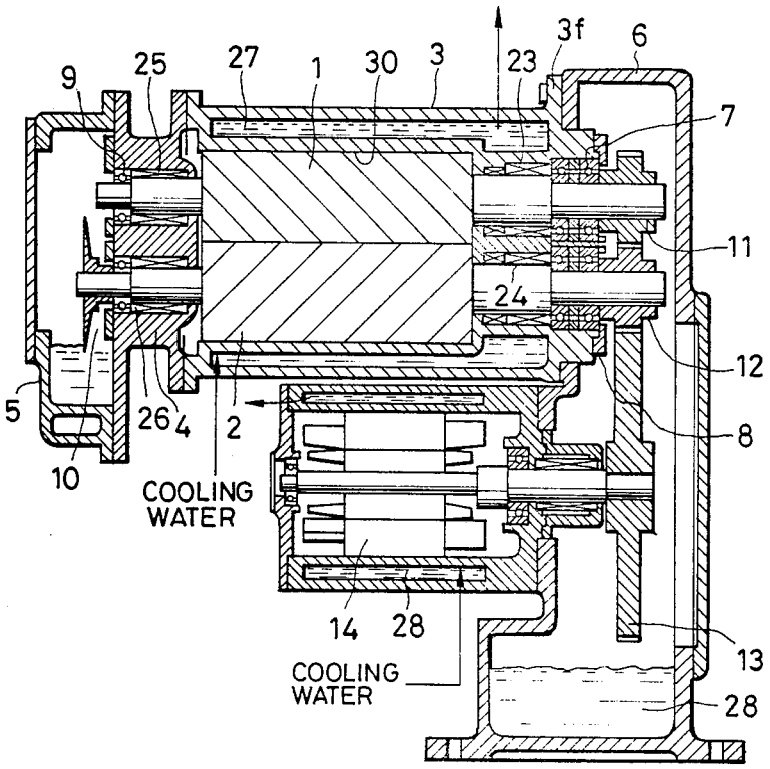
FIG. 2 is a sectional view taken along line II—II in FIG. 1.
Figure 3:
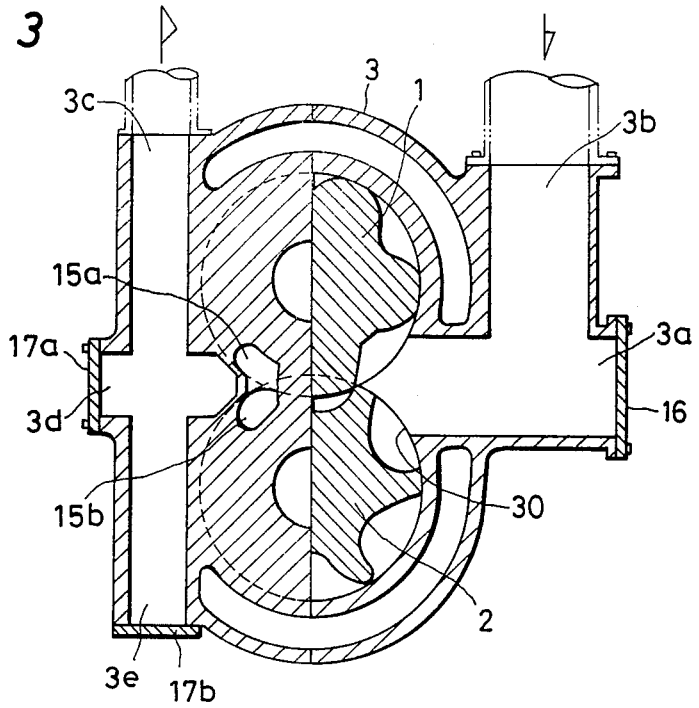
FIG. 3 is a sectional view taken along line III—III in FIG. 1.

FIG. 1 is an exterior view of a screw vacuum pump unit which has two suction ports, FIG. 2 is a sectional view taken along line II—II in FIG. 1, and FIG. 3 is a sectional view taken along line III—III in FIG. 1.

A male rotor 1 has a plurality of twisted lands and grooves, while a female rotor 2 has a plurality of twisted grooves and lands. The lands of the male rotor 1 are shaped so as to mesh with the grooves of the female rotor 2, and the grooves of the male rotor 1 so as to mesh with the lands of the female rotor 2. A screw casing is constructed of a main casing 3, and an end casing 4 which is coupled to one end face of the main casing 3 by bolts. The main casing 3 defines therein a working chamber 30, which is surrounded with a water jacket 27. A cover 5 is coupled to the end face of the end casing 4 remote from the main casing 3. The male rotor 1 and female rotor 2 mentioned above are received in the working chamber 30 of the main casing 3.

Bearings 7, 8 and shaft seals 23, 24 are arranged between both the rotors 1, 2 and the main casing 3. Likewise, bearings 9, 10 and shaft seals 25, 26 are arranged between both the rotors 1, 2 and the end casing 4. The two rotors 1 and 2 are rotatably supported by the bearings 7, 8, 9 and 10.

Gears 11 and 12 are coupled to one end side of both the rotors 1, 2, and they mesh with each other. The gear 12 meshes with a drive gear 13 which is coupled to the shaft of a motor 14. The gears 11, 12 and the drive gear 13 are received in the gear casing 6 of a speed change gear. Herein, the male rotor r1, female rotor 2 and motor 14 are arranged respectively one below the other in such a manner that the respective axes of both the rotors 1, 2 and the motor 14 are horizontal and are parallel to one another and that the axes as viewed from the gear side are aligned within a plane extending in the perpendicular (vertical) direction. That is, the axis centers of the rotors 1 and 2 and the motor 14 are arranged one below the other on a vertical line so as to decrease the width of the pump in the horizontal direction. The motor 14 and the screw casing, which receives the male rotor 1 and the female rotor 2 therein, are arranged on one side of the gear casing 6, and the flange 3*f* of the main casing 3 is coupled to the gear casing 6 by bolts. The main casing 3 is provided with suction ports 3*a*, 3*b* on one side thereof, and with discharge ports 3*c*, 3*d*, 3*e* on the other side thereof. The suction ports 3*a* and 3*b* are held in communication with the working chamber 30 by the suction port 3*a*, while the discharge ports 3*c*, 3*d* and 3*e* are held in communication with the same by the discharge port 3*d*. The suction port 3*a* extends in the horizontal direction, and the suction port 3*b* communicates therewith orthogonally from above. On the other hand, the discharge port 3*d* can discharge gases in the horizontal direction, the discharge port 3*c* communicates with the port 3*d* orthogonally from above, and the discharge port 3*e* communicates with the port 3*d* orthogonally from below. In other words, the suction port is composed of a suction port 3*a* capable of sucking in the horizontal direction and a suction port 3*b* capable of sucking in a direction orthogonal to suction port 3*a*. The discharge port 3*d* can discharge in the horizontal direction, whereas discharge port 3*c* can discharge in one direction orthogonal to port 3*d* and port 3*e* can discharge in another direction orthogonal to port 3*d*. As a result, the suction port has two possible directions and the discharge port has three possible directions to facilitate piping and maintenance. Numeral 16 designates a suction side stop collar, and symbols 17*a* and 17*b* denote discharge side stop collars.

The details of the structure of the screw block are substantially the same as described in the specification of U.S. Ser. No. 701,199, and the details of the shaft seals 23, 24, 25 and 26 as described in U.S. Pat. No. 4,487,563.

Besides, the embodiment comprises an oil pump (not shown) which feeds oil 29 to the meshing parts of the bearings 7, 8, 9 and 10 and the gears 11, 12 and 13.

When the motor 14 is driven, the rotors 1 and 2 are rotated through the drive gear 13 and the gears 11 and 12, and the fluid of a chamber to be evacuated is imbibed from the suction port 3*b* into the working chamber 30 (in FIG. 3, the suction port 3*a* is held closed by the stop collar 16) and is emitted from the discharge port 3*c* through discharge openings 15*a* and 15*b* (in FIG. 3, the discharge ports 3*d* and 3*e* are held closed by the respective stop collars 17*a* and 17*b*). In a case where the fluid is to be imbibed from the suction port 3*a* for the convenience of piping, it is easy that the suction side stop collar 16 is detached to open the suction port 3*a* and that the suction port 3*b* is closed. Likewise, on the discharge side, it is easy to select a necessary one from among the discharge ports 3*c*, 3*d* and 3*e* and to connect a pipe thereto. In addition, in such a case where deposits having adhered to the interior of the vacuum pump unit due to reaction gases are to be cleared, a vertically penetrating passage extending from the discharge port (a passage extending from the discharge port 3*c* in communication therewith) makes it possible to sweep away the deposits with a brush or the like from the upper discharge port 3*c* and to put them out from the lower discharge port 3*e*. Therefore, operations for maintenance can be readily performed.

According to the present embodiment, the rotors 1, 2 and the motor 14 are so arranged that their axes are horizontal and are parallel to one another and that the axes viewed from the axial end side are aligned on the perpendicular plane. Moreover, the screw casing which receives the male rotor 1 and female rotor 2 therein, and the motor 14 are arranged on one side of the gear casing 6. Therefore, the widthwise and lengthwise dimensions of the pump proper can be sharply reduced to make the installation area smaller, and suction and discharge pipes can be readily connected to facilitate operations for maintenance such as the clearing of deposits at the discharge ports.

Figure 4:
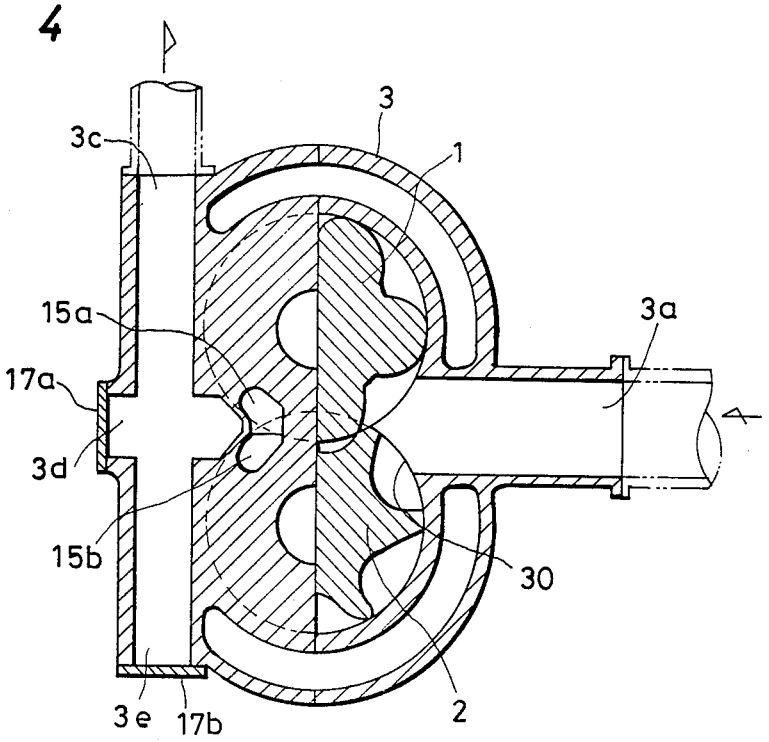
FIG. 4 is a sectional view showing an embodiment of the present invention in which only one horizontal suction port is provided.

FIG. 4 is a sectional view corresponding to FIG. 3, of a screw vacuum pump unit which shows an embodiment of the present invention and which is provided with a single horizontal suction port.

Figure 5:
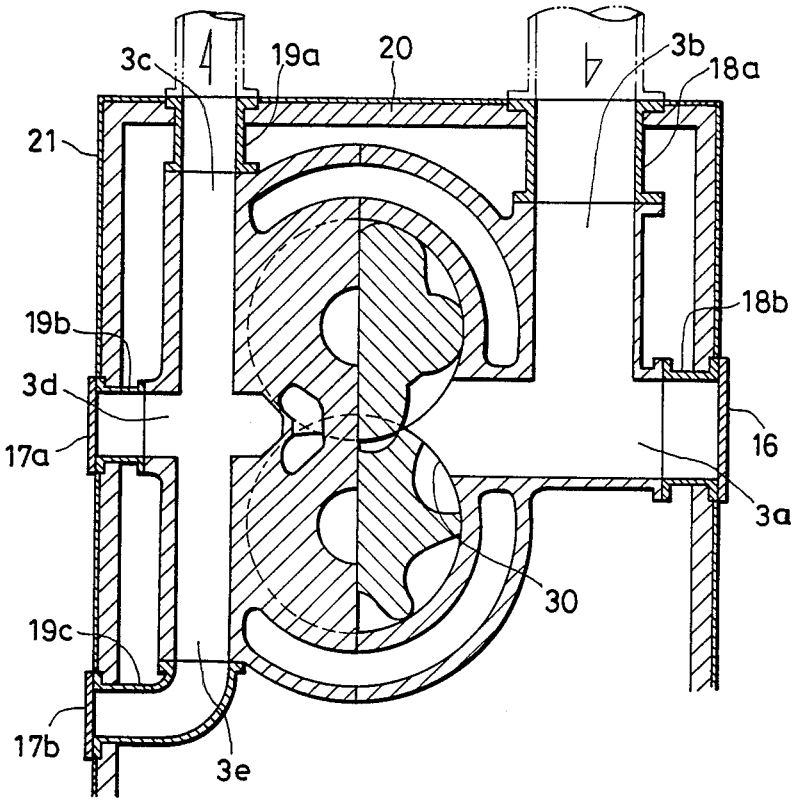
FIG. 5 is a sectional view showing an embodiment of the present invention in the case where the whole vacuum pump is enveloped in a sound-insulating cover.

FIG. 5 is a sectional view showing an embodiment in which the present invention is applied to a case of enveloping the whole vacuum pump in a sound-insulating cover in order to reduce noise (this figure corresponds to a section III—III in the case of enveloping the whole vacuum pump of FIG. 1 in a sound-insulating cover). Referring to FIG. 5, symbols 18*a* and 18*b* denote suction pipes which connect the sound-insulating cover 21 and the suction ports of the pump proper, symbols 19*a*, 19*b* and 19*c* denote discharge pipes which connect the sound-insulating cover and the discharge ports of the pump proper, and numeral 20 denotes a sound-absorbing material which is stuck to the inner surface of the sound-insulating cover. As illustrated in the figure, a plurality of piping ports are provided in the upper parts and sideward parts of the sound-insulating cover. This brings forth the effect that piping is very easy. Moreover, the discharge ports 3*c*, 3*d* and 3*e* are provided in three directions, so that when reaction products have deposited at the discharge ports, the deposits can be readily cleared from the upper port 3*c* or the horizontal port 3*d* and put out from the lower port 3*e*. This brings forth the effect that the maintenance of the pump unit is very easy.

Figure 6:
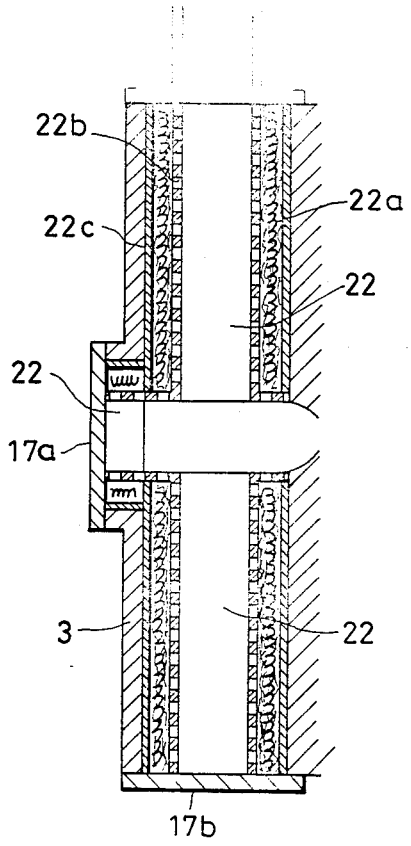
FIG. 6 is a sectional view of the essential portions of an embodiment in which a silencer cartridge is arranged in a discharge port.
Figure 7:
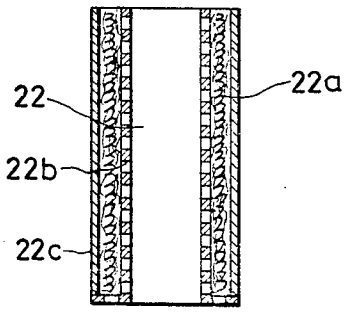
FIG. 7 is a sectional view of the silencer cartridge.

FIG. 6 shows an embodiment in which silencer cartridges 22 are inserted in the discharge ports 3*c*, 3*d* and 3*e* in order to facilitate the clearing and simultaneously to silence the pump unit. As shown in FIG. 7, the silencer cartridge 22 is constructed of an outer cylinder 22*c*, an inner cylinder 22*b* which is formed of a punching metal plate (porous steel plate), and a sound-absorbing material 22*a* which is packed between the inner and outer cylinders 22*b*, 22*c*.

When the silencer cartridges 22 are inserted in the discharge ports in this manner, reaction products deposit on the inner surfaces of these silencer cartridges. When a predetermined period of time has lapsed or when the pump unit is to be inspected, the stop collars 17*a* and 17*b* are detached, and the silencer cartridges 22 are replaced with new ones, whereby the reaction products having deposited at the discharge ports or in discharge regions can be eliminated.

What is claimed is:

1. In a screw vacuum pump unit comprising a screw casing which defines a working chamber and which has suction ports and discharge ports communicating with the working chamber, a screw block having a male rotor and a female rotor that are rotatably received in the working chamber about horizontal axes and meshing with each other, a motor with a driving gear rotating about a horizontal axis, a speed change gear means directly engaging the driving gear and having transmission means for transmitting rotation of the motor directly to the rotors, and a casing for receiving the transmission means therein, wherein said screw block, said speed change gear means and said motor are mounted on one side of said screw casing, the axes of said male and female rotors and of said motor are arranged in a vertical plane between said suction ports and said discharge ports.

2. A screw vacuum pump unit according to claim 1, wherein said male rotor, said female rotor and said motor are arranged with the male rotor above the female rotor in the screw block and with the motor below the screw block.

3. A screw vacuum pump unit according to claim 1, wherein said discharge ports are arranged near said casing of said speed change gear, means, and said suction ports are arranged at positions remote from said casing of said speed change gear means.

4. A screw vacuum pump unit according to claim 3, wherein said male rotor, said female rotor and said motor are arranged with the male rotor above the female rotor in the screw block and with the motor below the screw block.

5. In a screw vacuum pump unit comprising a screw casing which defines a working chamber and suction ports and discharge ports communicating with the working chamber, a screw block having a male rotor and a female rotor rotatably received in the working chamber about horizontal axes and meshing with each other, a motor with a driving gear rotating about a horizontal axis, a speed change gear means having transmission means directly engaging the driving gear for directly transmitting rotation of the motor to the rotors, and a casing for receiving the speed change gear means therein, wherein said screw block, said speed change gear means and said motor are mounted on one side of said screw casing, the axes of said male and female rotors and of said motor are arranged in a vertical plane between said suction ports and said discharge ports, and said discharge ports comprise a port which extends horizontally and of ports which extend orthogonally to the horizontally extending port.

6. A screw vacuum pump unit according to claim 5, wherein said male rotor, said female rotor and said motor are arranged with the male rotor above the female rotor in the screw block and with the motor below the screw block.

7. A screw vacuum pump unit according to claim 5, wherein said discharge ports are arranged near said casing of said speed change gear, means, and said suction ports are arranged at positions remote from said casing of said speed change gear means.

8. In a screw vacuum pump unit comprising a screw casing defining a working chamber and having suction ports and discharge ports communicating with the working chamber, a screw block having a male rotor and a female rotor rotatably received about horizontal axes in the working chamber and meshing with each other, a motor with a driving gear rotated about a horizontal axis, a speed change gear for transmitting rotation of the motor to the rotors, and a casing for enveloping the gearing, wherein said screw block, said change speed gear means and said motor are coupled to one side of said screw casing by flanges, the axes of said rotors and axis of said motor are arranged in a vertical plane between said suction ports and said discharge ports.

9. A screw vacuum pump unit according to claim 8, where said male rotor, said female rotor and said motor are arrayed with the male rotor above the female rotor in the screw block and with said motor below the screw block.

10. A screw vacuum pump unit according to claim 8, wherein said discharge ports are arranged near said casing of said speed change gear, means, and said suction ports are arranged at positions remote from said casing of said speed change gear means.

11. In a screw vacuum pump unit comprising a screw casing defining a working chamber having suction ports and discharge ports communicating with the working chamber, a screw block having a male rotor and a female rotor rotatably received about horizontal axes in the working chamber and meshing with each other, a motor with a driving gear rotating about a horizontal axis, speed change gear means having transmission means directly engaging the driving gear for transmitting rotation of the motor directly to the rotors, and a casing for receiving the transmission means therein said screw block, said speed change gear means and said motor are mounted on one side of said screw casing, the axes of said male and female rotors and of said motor are arranged in a vertical plane between said suction ports and said discharge ports, said discharge ports comprise a port which extends horizontally and of ports which extend orthogonally to the horizontally extending port, and a silencer cartridge is provided in the orthogonally extending ports of the discharge port.

12. A screw vacuum pump unit according to claim 11, wherein said silence cartridge comprises an outer cylinder, an inner cylinder formed with a large number of pores, and sound absorbing material interposed between said inner cylinder and said outer cylinder.

* * * * *